US011330956B2

(12) United States Patent
Eisenbart et al.

(10) Patent No.: US 11,330,956 B2
(45) Date of Patent: May 17, 2022

(54) WATER-BEARING DOMESTIC APPLIANCE

(71) Applicant: BSH Hausgeräte GmbH, Munich (DE)

(72) Inventors: Bernd Eisenbart, Holzheim (DE); Michael Lugert, Jettingen-Scheppach (DE); Georg Hausmann, Blindheim (DE); Andreas Heidel, Holzheim (DE); Anton Oblinger, Wertingen (DE)

(73) Assignee: BSH Hausgeräte GmbH, Munich (DE)

( * ) Notice: Subject to any disclaimer, the term of this patent is extended or adjusted under 35 U.S.C. 154(b) by 256 days.

(21) Appl. No.: 16/603,872

(22) PCT Filed: May 7, 2018

(86) PCT No.: PCT/EP2018/061648

§ 371 (c)(1),
(2) Date: Oct. 9, 2019

(87) PCT Pub. No.: WO2018/210594

PCT Pub. Date: Nov. 22, 2018

(65) Prior Publication Data

US 2020/0113407 A1 Apr. 16, 2020

(30) Foreign Application Priority Data

May 19, 2017 (DE) ..... 10 2017 208 527.4

(51) Int. Cl.

| | |
|---|---|
| ***A47L 15/22*** | (2006.01) |
| ***A47L 15/42*** | (2006.01) |
| ***D06F 33/30*** | (2020.01) |
| *D06F 103/44* | (2020.01) |
| *D06F 105/00* | (2020.01) |

(52) U.S. Cl.

CPC ..... *A47L 15/22* (2013.01); *A47L 15/4221* (2013.01); *D06F 33/30* (2020.02); *A47L 2401/07* (2013.01); *A47L 2401/24* (2013.01); *A47L 2401/30* (2013.01); *A47L 2501/20* (2013.01); *D06F 2103/44* (2020.02); *D06F 2105/00* (2020.02)

(58) Field of Classification Search

CPC .. A47L 15/22; A47L 15/4221; A47L 2401/07; A47L 2401/24

See application file for complete search history.

(56) References Cited

U.S. PATENT DOCUMENTS

| | | | |
|---|---|---|---|
| 82,268,088 | | 9/2012 | Kranzle et al. |
| 8,734,594 | B2 | 5/2014 | Sundaram et al. |
| 8,852,354 | B2 | 10/2014 | Uz et al. |

(Continued)

OTHER PUBLICATIONS

National Search Report DE10 2017 208 527.4 dated Jan. 10, 2018.
International Search Report PCT/EP2018/061648 dated Jul. 10, 2018.

*Primary Examiner* — Spencer E. Bell
(74) *Attorney, Agent, or Firm* — Michael E. Tschupp; Andrea Pallapies; Brandon G. Braun

(57) ABSTRACT

A water-conducting household appliance includes a moving component, an electric motor for moving the component, a load apparatus configured to apply a resistance to counter movement of the component as a function of a position of the moving component, and a control apparatus for actuating the electric motor. The control apparatus is configured to detect a drive current drawn which is drawn by the electric motor and is a function of the resistance applied by the load apparatus and to ascertain the position of the moving component as a function of the detected drive current.

8 Claims, 5 Drawing Sheets

(56) References Cited

U.S. PATENT DOCUMENTS

| | | | |
|---|---|---|---|
| 2010/0121497 | A1 | 5/2010 | Heisele et al. |
| 2010/0212692 | A1 | 8/2010 | Sundaram |
| 2011/0120500 | A1 | 5/2011 | Heisele et al. |
| 2017/0332877 | A1 | 11/2017 | Pers et al. |

WATER-BEARING DOMESTIC APPLIANCE

CROSS-REFERENCES TO RELATED APPLICATIONS

This application is the U.S. National Stage of International Application No. PCT/EP2018/061648, filed May 7, 2018, which designated the United States and has been published as International Publication No. WO 2018/210594 A1 and which claims the priority of German Patent Application, Serial No. 10 2017 208 527.4, filed May 19, 2017, pursuant to 35 U.S.C. 119(a)-(d).

BACKGROUND OF THE INVENTION

The present invention relates to a water-conducting household appliance and a method for operating a water-conducting household appliance.

Water-conducting household appliances frequently have moving components, for example a water diverter, which moves and/or is moved to predetermined positions during operation of a respective appliance. In order to be able to move to a predetermined position specifically, it is necessary to know the current position of the component. A switching cam is conventionally used for example, sending a signal to a control apparatus when the moving component is moved over a specific position so the position is determined. However the switching cam has to be coupled to the control apparatus for this purpose. This is done using a signal cable for example, which increases the complexity of the appliance due to the additional wiring outlay. Corresponding inputs also have to be provided on the control apparatus. Such a solution is known for example from WO 2016/096019 A1.

BRIEF SUMMARY OF THE INVENTION

Against this background one object of the present invention is to provide an improved water-conducting household appliance.

According to a first aspect a water-conducting household appliance, in particular a dishwasher, is proposed, with a moving component, an electric motor for moving the component, a control apparatus for actuating the electric motor and a load apparatus for providing a resistance, which is a function of a position of the moving component and counter to the movement. The control apparatus is designed to detect the drive current, which is drawn by the electric motor and is a function of the resistance provided, and to ascertain the position of the moving component as a function of the detected drive current.

Such a water-conducting household appliance has the advantage that the position of the moving component can be ascertained, while being able to dispense with additional cabling to a position sensor and the position sensor itself. This in particular reduces the complexity of the water-conducting household appliance and lowers costs. The position of the moving component of the water-conducting household appliance is therefore advantageously identified without additional cabling outlay.

The electric motor is in particular configured as a brushless DC motor (BLDC motor). Such a BLDC motor is actuated for example with a predefined DC voltage. A direction of rotation and a rotation speed of the BLDC motor can for example be controlled here by way of a drive voltage. The direction of rotation here is a function in particular of a polarity of the drive voltage and the speed is a function of an amplitude or size of the drive voltage. Such a BLDC motor draws a drive current that is a function of a load. The greater the load, the greater the power of the BLDC motor. Therefore the BLDC motor draws a higher drive current with a large load than with a small load.

The control apparatus is designed to actuate the electric motor. To this end the control apparatus has a cable connection to the electric motor for example and can supply it with a predefined drive voltage. For example the control apparatus has a voltage source for this, in particular a voltage source with a controllable output voltage, for example a power supply unit or transformer. The voltage source is designed in particular to provide the predefined drive voltage. The electric motor draws a drive current, which is a function of the load and is provided by the voltage source.

The control apparatus can be implemented by means of hardware and/or software. In a hardware implementation the control apparatus can be configured as a computer or microprocessor. In a software implementation the control apparatus can be configured as a computer program product, function, routine, part of a program code or as an executable object. The control apparatus can in particular be a central control apparatus for operating the water-conducting household appliance.

The load apparatus in particular comprises a mechanical unit coupled to the moving component. The load apparatus provides a resistance counter to the movement of the moving component as a function of the position of the moving component. This resistance can be generated for example by friction.

For example the movement of the moving component has a natural resistance, which is a function in particular of the support of the moving component. This resistance is referred to in the following as the basic resistance. The basic resistance per se can already have a position-dependent size for example.

The load apparatus is designed to change this basic resistance specifically as a function of position. This can include both reducing the resistance locally and also increasing the resistance locally.

For example the moving component is a spray arm of a dishwasher. The spray arm is supported in a rotatable manner, rotation of the spray arm for example consuming a power loss of 1.2 W without a load apparatus. The electric motor provides this power during operation with a drive voltage of 12 V by drawing a drive current of 0.1 A. If the load apparatus is designed to provide an increased resistance in a rotational movement range, for example 0°-10°, so the power loss is doubled to 2.4 W in this range, the electric motor draws a drive current of 0.2 A to provide this power, in order to maintain the rotational movement of the spray arm in a regular manner over this range.

The control apparatus is designed to detect the drive current drawn by the electric motor and to ascertain the position of the moving component from this. To this end the control apparatus has an ammeter for example. Detection can also include storing a detected value. To ascertain the position of the moving component, the control apparatus is designed in particular to compare a detected value with a reference value, to make assignments and/or to perform different calculations. Such calculations include for example ascertaining functional values and/or performing pattern recognition, in particular a spectral frequency analysis. In the example set out above it can be concluded from the doubling of the drive current that the position of the spray arm is in the range between 0° and 10°.

According to one embodiment of the water-conducting household appliance the moving component is configured as a water-conducting component, in particular as a spray arm of a dishwasher or as a water diverter.

Such components are designed for example to execute a rotational movement. To this end they are mounted for example on a rotation axis, such as a shaft or drive axle, which is supported in a rotatable manner.

According to a further embodiment of the water-conducting household appliance the moving component is designed to perform a rotating movement about an axis.

Such a rotational movement is in particular periodic; in other words the movement is repeated after a complete rotation of the moving component. For example the load apparatus is designed to provide an increased resistance at 90° intervals for 5° respectively. During the course of a complete rotation of the moving component the drive current drawn by the electric motor is therefore increased four times. Increased here is in relation in particular to the drawn drive current at positions in which the resistance is not provided or not increased by the load apparatus but where only the basic resistance is active.

According to a further embodiment of the water-conducting household appliance the load apparatus is designed to provide a resistance that is a function of a degree of rotation of the moving component.

The degree of rotation can be given for example as an angle relative to an initial angle. As such a rotational movement is periodic, the initial angle can be freely selected.

According to a further embodiment of the water-conducting household appliance the load apparatus comprises a transmission unit for coupling the electric motor to the moving component.

In this embodiment the load apparatus therefore has a double function: on the one hand it provides the position-dependent resistance, on the other hand it couples the electric motor to the moving component.

According to a further embodiment of the water-conducting household appliance the transmission unit is designed to reduce a rotation speed of the electric motor by a predefined factor when coupling the electric motor to the moving component.

The predefined factor is also referred to as a gear reduction. Such a gear reduction can in particular change a drive torque for the moving component. A gear reduction is also advantageous for example in order to reduce a high rotation speed of the electric motor and to increase uniformity of movement.

According to a further embodiment the transmission unit is designed to convert a rotational movement provided by the electric motor to a linear movement.

According to a further embodiment of the water-conducting household appliance the load apparatus is designed to provide the resistance according to a predetermined load function as a function of the degree of rotation of the moving component.

The resistance therefore has a resistance value as a function of the degree of rotation. For example the resistance value can increase linearly in proportion to the degree of rotation and drop back to the initial value after a complete rotation. In this embodiment it is possible to map the position of the moving component, which is shown here by the degree of rotation, clearly onto the resistance value and therefore also onto the drive current drawn by the electric motor.

According to a further embodiment of the water-conducting household appliance the load apparatus is designed to provide the resistance as an increased resistance and/or reduced resistance relative to a basic resistance, which corresponds to the resistance when the moving component moves without the load apparatus.

In this embodiment the position can be identified robustly in particular in respect of interference, for example chaotically occurring hydrodynamic disturbance variables or even mechanical disturbance variables, for example due to dirt particles that counteract movement. Such interference or disturbance variables result in particular in locally increased resistance, for example because a dirt particle inhibits the course of movement. If such a dirt particle adheres in a certain position, the electric motor draws an increased drive current every time the moving components passes over this position. This could result in incorrect position identification. Such incorrect position identification is excluded in particular by providing a local resistance reduction, which cannot originate from one of the cited disturbance variables.

Such a resistance reduction relative to the basic resistance can be achieved for example by a load apparatus, which at the same time acts as a transmission unit to couple the electric motor to the moving component. To this end provision is made for example for suspending a transfer of force from the electric motor to the moving component at certain points. The moving component is therefore not driven at such points so the basic resistance due to the moving component drops in particular to zero. The drive current drawn by the electric motor is therefore also zero or at least almost zero. A deviation from zero can result here in particular due to losses ascribable to the electric motor itself.

According to a further embodiment of the water-conducting household appliance the control apparatus is designed to actuate the electric motor as a function of the ascertained position of the moving component in such a manner that the moving component is moved into a predetermined position.

A predetermined position can be determined for example by a specific degree of rotation. For example specific cleaning of predefined or even dynamically determined regions in the dishwasher can be achieved by moving a spray arm of a dishwasher into a predetermined position. This allows a flatware basket for example to be targeted specifically and selectively.

According to a further embodiment of the water-conducting household appliance the control apparatus is designed to actuate the electric motor to perform a complete movement amplitude to ascertain a current load function of the moving component and to detect the drive current drawn by the electric motor in the process.

Such an operation can also be referred to as standardization or calibration. The moving component is arranged for example in an environment exposed to widely varying conditions, for example a washing chamber of a dishwasher. It can be the case here that the mechanical properties of the movement of the moving component change, for example due to soiling, over the working life of the water-conducting household appliance. If such a calibration is performed for example before each use of the water-conducting household appliance, it is possible to detect the drive current drawn by the electric motor during regular performance of the movement and to store it as a reference. The control apparatus is then in particular designed to ascertain the position of the moving component as a function of said reference.

A complete movement amplitude here means that the moving component reaches every position the moving component can reach just once. It is also possible to distinguish a respective position based on different movement directions. In the case of a linear oscillation movement from a left stop to a right stop the complete movement amplitude for example comprises the movement from the left stop to the right stop and back again.

Because the moving component is actuated to perform a complete movement amplitude, it can also be ascertained whether for example an object, such as an item to be washed in a dishwasher, is blocking the course of movement. If so, provision can also be made for outputting a corresponding error message or warning to a user of the dishwasher.

According to a further embodiment of the water-conducting household appliance the control apparatus is designed to identify blocking of the moving component as a function of the drive current drawn by the electric motor.

According to a further embodiment of the water-conducting household appliance the water-conducting household appliance is configured as a dishwasher, a washing machine or a tumble dryer.

According to a further aspect a method is proposed for operating a water-conducting household appliance, in particular a dishwasher, with a moving component, an electric motor for moving the component and a control apparatus for actuating the electric motor. In a first method step the electric motor is actuated. For example the control apparatus supplies a constant DC voltage to the electric motor. In a second method step a load apparatus provides a resistance, which is a function of a position of the moving component and counter to the movement. In a third method step a drive current is detected, which is drawn by the electric motor and a function of the resistance provided. Detected means for example recorded, read or measured. In a fourth method step the position of the moving component is ascertained as a function of the detected drive current. For example the detected drive current is an unambiguous function of the position. It is then possible to derive or calculate the position directly from the detected drive current by inversion. A table can also be provided, in which values for the detected drive current are assigned to a position. This can also be referred to as a look-up table.

The embodiments and features of the proposed water-conducting household appliance apply correspondingly to the proposed method.

A computer program product is also proposed, which prompts the performance of the method as described above on a program-controlled facility.

A computer program product, for example a computer program means, can be provided or supplied for example as a storage medium, for example a memory card, USB stick, CD-ROM, DVD or even in the form of a downloadable file from a server in a network. This can take place for example in a wireless communication network by transferring a corresponding file containing the computer program product or the computer program means.

Further possible implementations of the invention comprise combinations of features or embodiments described above or in the following with regard to the exemplary embodiments even if these are not cited specifically. The person skilled in the art will also add individual aspects to improve or complete the respective basic form of the invention.

BRIEF DESCRIPTION OF THE DRAWINGS

Further advantageous configurations and aspects of the invention are set out in the subclaims and the exemplary embodiments of the invention described in the following. The invention is also described in more detail based on preferred embodiments with reference to the accompanying figures.

DETAILED DESCRIPTION OF EXEMPLARY EMBODIMENTS OF THE PRESENT INVENTION

Figure 1:
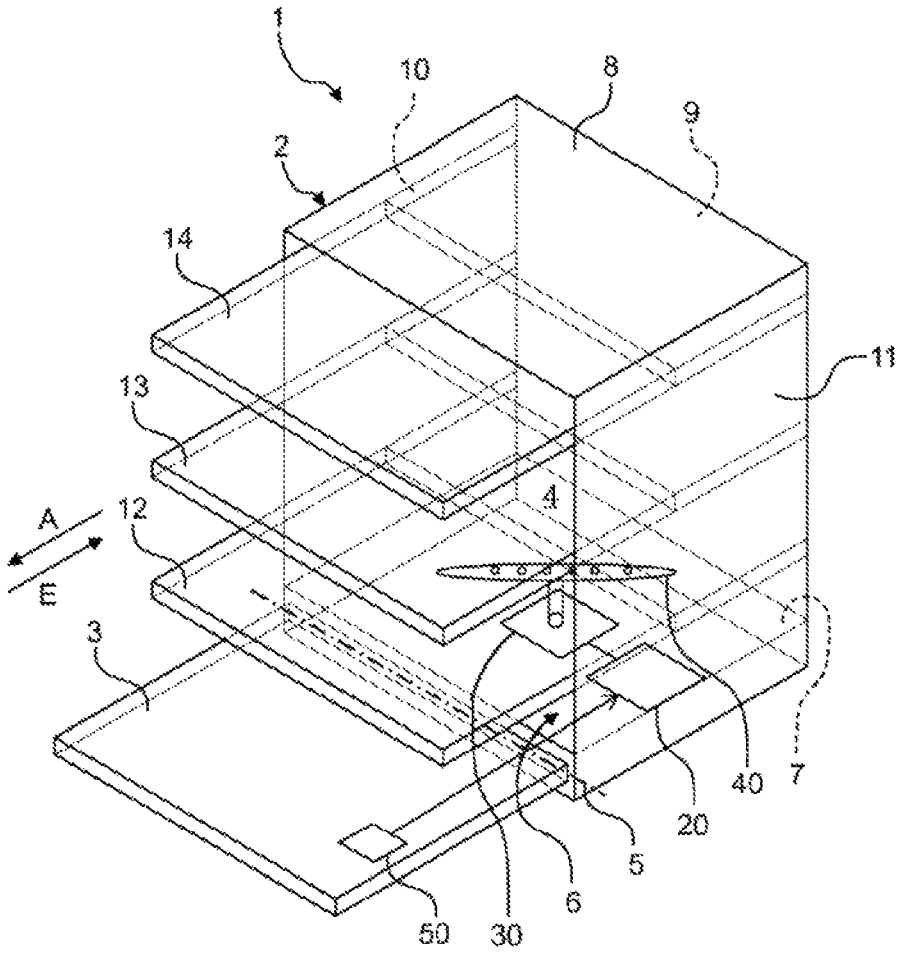
FIG. 1 shows a schematic perspective view of an embodiment of a water-conducting household appliance.

Identical elements or those of identical function are shown with the same reference characters in the figures, unless otherwise specified.

FIG. 1 shows a schematic perspective view of an embodiment of a water-conducting household appliance 1, configured here as a household dishwasher. The household dishwasher 1 comprises a dishwashing container 2, which can be closed by a door 3, in particular in a watertight manner. To this end a sealing facility (not shown) can be provided between the door 3 and the dishwashing container 2. The dishwashing container 2 is preferably box-shaped. The dishwashing container 2 can be arranged in a housing of the household dishwasher 1. The dishwashing container 2 and door 3 can form a wash chamber 4 for washing items to be washed.

The door 3 is shown in its opened position in FIG. 1. The door 3 can be closed or opened by pivoting about a pivot axis 5 provided at a lower end of the door 3. The door 3 can be used to close or open a loading opening 6 of the dishwashing container 2. The dishwashing container 2 has a base 7, a top 8 arranged opposite the base 7, a rear wall 9 arranged opposite the closed door 3 and two opposing side walls 10, 11. The base 7, the top 8, the rear wall 9 and the side walls 10, 11 can be made of stainless steel sheet for example. Alternatively the base 7 can be made of a plastic material.

The household dishwasher 1 also has at least one receptacle 12, 13, 14 for items to be washed. A number of, for example three, receptacles 12, 13, 14 for items to be washed can preferably be provided, it being possible for the receptacle 12 for items to be washed to be a lower receptacle for items to be washed or a lower rack, the receptacle 13 for items to be washed to be an upper receptacle for items to be washed or an upper rack and the receptacle 14 for items to be washed to be a flatware drawer. As also shown in FIG. 1 the receptacles 12, 13, 14 for items to be washed are arranged one above the other in the dishwashing container 2. Each receptacle 12 to 14 for items to be washed can be moved as required into the dishwashing container 2 or out of it. In particular each receptacle 12, 13, 14 for items to be washed can be pushed into the dishwashing container 2 in an insertion direction E and can be pulled out of the dishwashing container 2 in a pull-out direction A counter to the insertion direction E.

An electric motor 20, a load apparatus 30 and a moving component 40 are also arranged on the base 7 of the household dishwasher 1. The electric motor 20 is designed to move the moving component 40, which is configured as a spray arm of the household dishwasher 1 here, in particular at a predefined speed. To this end the electric motor 20 is in particular coupled mechanically to the spray arm 40. The spray arm 40 is supported rotatably on an axis (not shown). Movement of the spray arm 40 therefore corresponds to rotation or rotational movement and the predefined speed to a predefined angular speed. The load apparatus 30 is coupled to the rotational movement of the spray arm 40 and is designed to counter the rotation with a resistance, which is a function of the position of the spray arm 40. The position of the spray arm 40 is in particular unambiguously defined by a degree of rotation between 0 and 360°. The resistance countering the rotation means that the spray arm 40 is slowed, reducing the angular speed or rotational frequency of the spray arm 40. A temporarily higher drive power is required to maintain the predefined angular speed. To achieve this, the electric motor 20 temporarily draws an increased drive current $I_0$, $I_1$, $I_2$ (see FIGS. 2*a*, 2*b*). The duration of the time interval during which the drive current is increased here is a function in particular of the predefined angular speed and also the angle range in which the resistance is increased.

A control apparatus 50 is also arranged on the door 3 of the household dishwasher 1. The control device 50 is designed to actuate the electric motor 20 to move the spray arm 40. In particular the control apparatus 50 supplies the electric motor 20 with a predefined drive voltage for this purpose and makes the drive current $I_0$, $I_1$, $I_2$ drawn by the electric motor 20 available. The control apparatus 50 is also designed to detect the drive current $I_0$, $I_1$, $I_2$ drawn by the electric motor 20. Based on the detected drive current $I_0$, $I_1$, $I_2$ the control apparatus 50 is also designed to ascertain the position of the spray arm 40. To this end provision can be made for the control apparatus 50 to compare values, perform calculations, determine functional values, perform pattern recognition, in particular a spectral analysis, and/or make assignments.

Figure 2A:
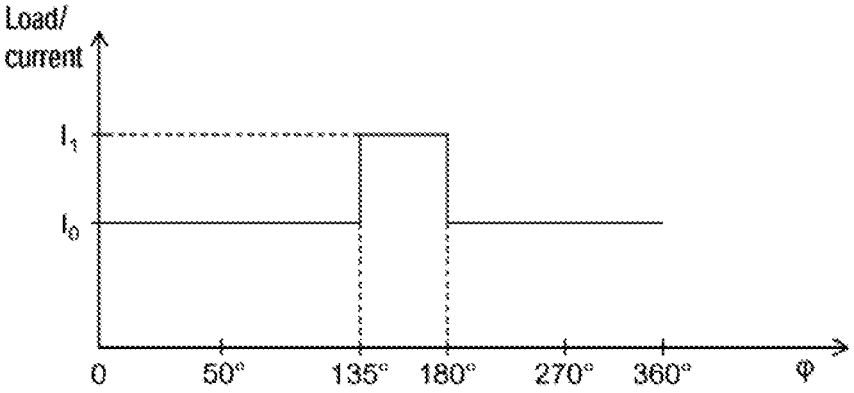
FIGS. 2*a* and 2*b* each show a diagram of a drive current drawn by an electric motor.

FIG. 2*a* shows a diagram of a drive current $I_0$, $I_1$ drawn by an electric motor 20 as a function of a degree of rotation φ of a moving component 40. It is for example the electric motor 20 of the household dishwasher 1 illustrated in FIG. 1, which is designed to move the spray arm 40.

A certain basic power is required to move the spray arm 40 and this is for example a function of the manner in which the spray arm 40 is supported. The electric motor 20 achieves this basic power in the present example by drawing a drive current of amplitude $I_0$. A load apparatus 30 is also provided, which counters movement with an increased resistance in a range of the degree of rotation φ of the spray arm 40 from 135° to 180°. In this range a greater power is required to perform the rotational movement, in particular with a predefined angular speed. Therefore in this range the electric motor 20 draws a greater drive current $I_1$ to provide this increased power. The control apparatus 50 is designed to detect the drawn drive current $I_0$, $I_1$, for example as a function of the degree of rotation φ of the spray arm 40 and to ascertain the position of the spray arm 40 as a function of this.

To this end for example the control apparatus 50 compares the detected drive current $I_0$, $I_1$ with a value stored in a storage unit (not shown), which corresponds to the drive current for basic power. If the detected drive current $I_0$, $I_1$ is greater than the stored value, the position of the spray arm 40 is in a degree of rotation range from 135°-180°. Alternatively or additionally the control apparatus 50 is designed for example to determine a change in the detected drive current $I_0$, $I_1$ and to ascertain the position of the spray arm 40 from this. As soon as the spray arm 40 passes beyond 135°, the drive current $I_0$, $I_1$ suddenly increases, resulting in a significant positive change signal. A significant negative change signal results correspondingly when the spray arm 40 passes beyond 180°. In this example therefore the position of the spray arm 40 can be ascertained precisely at two points.

Figure 2B:
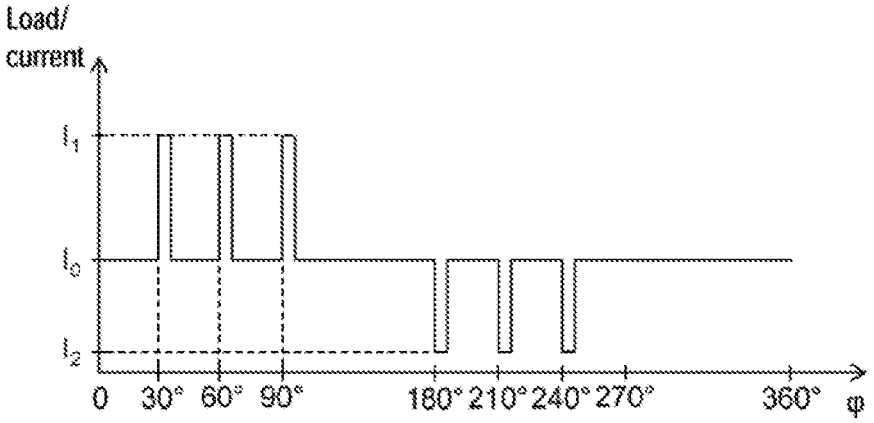

FIG. 2*b* shows a further diagram of a drive current $I_0$, $I_1$, $I_2$ drawn by an electric motor 20 as a function of a degree of rotation φ of a moving component 40. It is for example the electric motor 20 of the household dishwasher 1 illustrated in FIG. 1, which is designed to move the spray arm 40. A load apparatus 30 (see for example FIG. 1) is also provided, providing a resistance to the rotational movement of the spray arm 40 as a function of position.

In contrast to the example in FIG. 2*a*, three load levels are shown in FIG. 2*b*, being characterized by a respective drive current $I_0$, $I_1$, $I_2$. The basic load corresponds to a drive current $I_0$, an increased load corresponds to a drive current $I_1$ and a reduced load corresponds to a drive current $I_2$. In this example three ranges with increased load are provided in the first 90°, at 30° intervals respectively, each spanning 5°-10°. After a further 90° three ranges follow, also at 30° intervals, in which the load is reduced for 5°-10° respectively. The drive current $I_0$, $I_1$, $I_2$ drawn by the electric motor 20 is therefore increased or reduced in the respective ranges.

In this example the control apparatus 50 is therefore able to ascertain the position of the spray arm 40 very precisely.

Figure 3A:
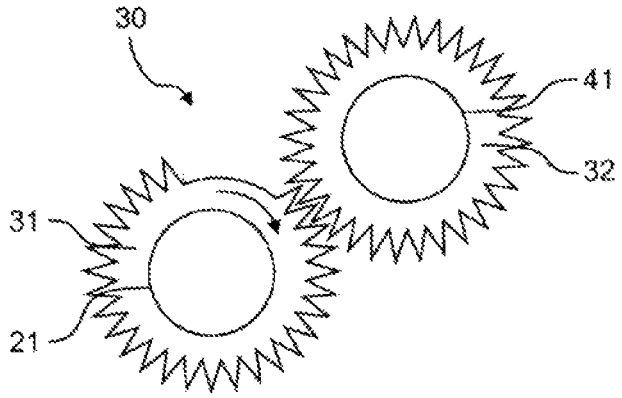
FIGS. 3*a*-3*c* show an embodiment of a load apparatus in one position respectively.
Figure 3B:
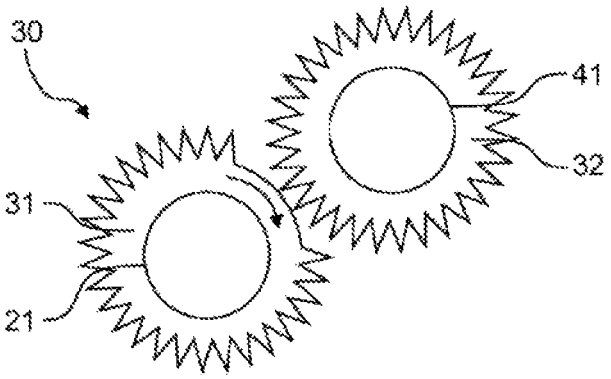
Figure 3C:
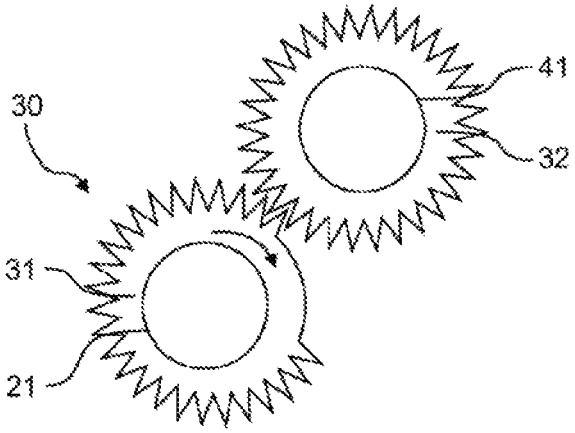

FIGS. 3*a*-3*c* show an embodiment of the load apparatus 30, for example the load apparatus 30 from FIG. 1, in one position respectively. In this example the load apparatus 30 comprises two toothed wheels 31, 32, which engage in one another. The first toothed wheel 31 is mounted on a shaft or drive axle 21, which is driven by the electric motor 20 (see FIG. 1), possibly by way of a transmission unit (not shown). The teeth of the first toothed wheel 31 engage in the teeth of the second toothed wheel 32, transferring a force to the second toothed wheel 32. The second toothed wheel 32 is mounted in particular on a shaft or drive axle 41, which is designed to drive or move a moving component 40 (see FIG. 1). The first toothed wheel 31 has the particular feature that there are no teeth present in a small angular range. When this angular range of the first toothed wheel 31 faces the second toothed wheel 32, no force is transferred to the second toothed wheel 32. This means that a load, which is coupled to the second toothed wheel 32, such as the moving component 40, is not driven in this range. No drive power is therefore required and a drive current $I_0$, $I_1$, $I_2$ (see FIGS. 2*a*, 2*b*) drawn by the electric motor 20 driving the first toothed wheel 31 is therefore reduced relative to a basic load.

FIG. 3*a* shows a moment when the second toothed wheel 32 is still being driven by the first toothed wheel 31. The first toothed wheel 31 nevertheless continues to rotate in the rotation direction shown, with the result that the angular range of the first toothed wheel 31, in which there are no teeth present, is rotated toward the second toothed wheel 32.

FIG. 3*b* shows a moment when the angular range of the first toothed wheel 31, in which there are no teeth present, is facing the second toothed wheel 32. In this position therefore the second toothed wheel 32 is also not driven and a load for the electric motor 20 and therefore also a drive current $I_0$, $I_1$, $I_2$ drawn by it are reduced. The moving component 40 possibly also continues to move at this moment due to movement inertia. However the movement is preferably slowed so the moving component 40 is in a defined position.

FIG. 3*c* shows a moment when the first toothed wheel engages in the second toothed wheel 32 again and therefore drives it again. The load and therefore also the drawn drive current $I_0$, $I_1$, $I_2$ are back to the basic level again after this time point. It can therefore happen that at the first moment, when the first toothed wheel 31 engages in the second toothed wheel 32 again, an increased load temporarily results, when the moving component 40 has been slowed for the time being and then speeded up again.

Figure 4A:
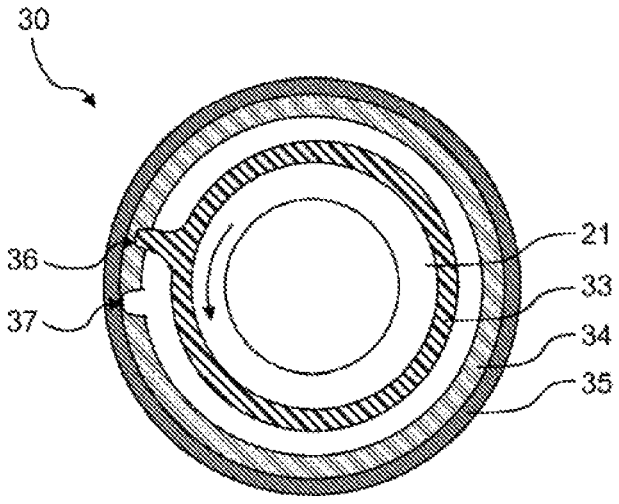
FIGS. 4*a* and 4*b* show a further embodiment of a load apparatus in one position respectively.
Figure 4B:
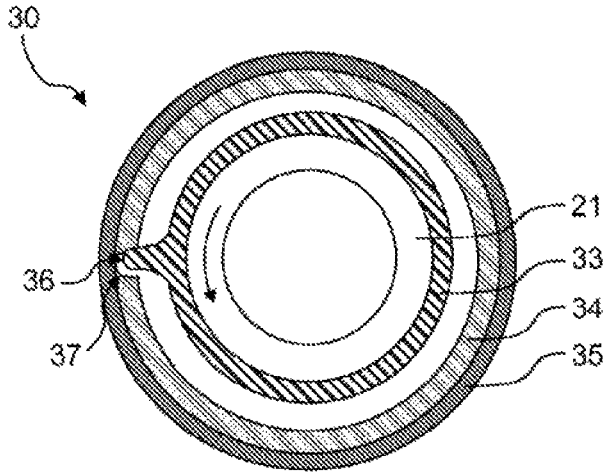

FIGS. 4*a* and 4*b* show a further embodiment of a load apparatus 30, for example the load apparatus 30 from FIG. 1, in one position respectively. In this example the load apparatus 30 has a concentric structure with cylindrical elements 33, 34, 35 arranged inside one another. A friction means 33 is arranged on an inner shaft or drive axle 21, being connected in a fixed manner to the drive axle 21. The friction means 33 comprises polymer components in particular. At a distance from the friction means 33, which forms a gap, is a friction layer 34, which for its part is arranged on the inner face of a sleeve 35 and connected in a fixed manner thereto. The sleeve 35 is connected in a fixed manner for example to an external housing (not shown) and therefore unmovable.

The friction means 33 has a particular feature in the form of a projection 36, which is so large that it bridges the gap between the friction means and the friction layer 34. In other words the projection 36 touches the friction layer 34 and rubs against it. This is shown by way of example in FIG. 4*a*. Such friction causes an increased resistance to counteract rotation of the drive axle 21. The projection 36 can be made of the same material as the friction means 33 but provision can also be made for it to be made of a different, in particular more robust, material or for a coating of a more robust material to be applied to it.

The friction layer 34 has a further particular feature in the form of a cutout 37. This cutout 37 is dimensioned such that the projection 36, when aligned in the direction of the cutout 37, no longer rubs against the friction layer 34. This is shown by way of example in FIG. 4*b*. Therefore the additional load generated by friction is no longer present in this alignment, in other words when the projection 36 is aligned toward the cutout 37.

Therefore an increased basic load, which is reduced specifically in one position, is generated for the load apparatus 30 in this exemplary embodiment.

Figure 5:
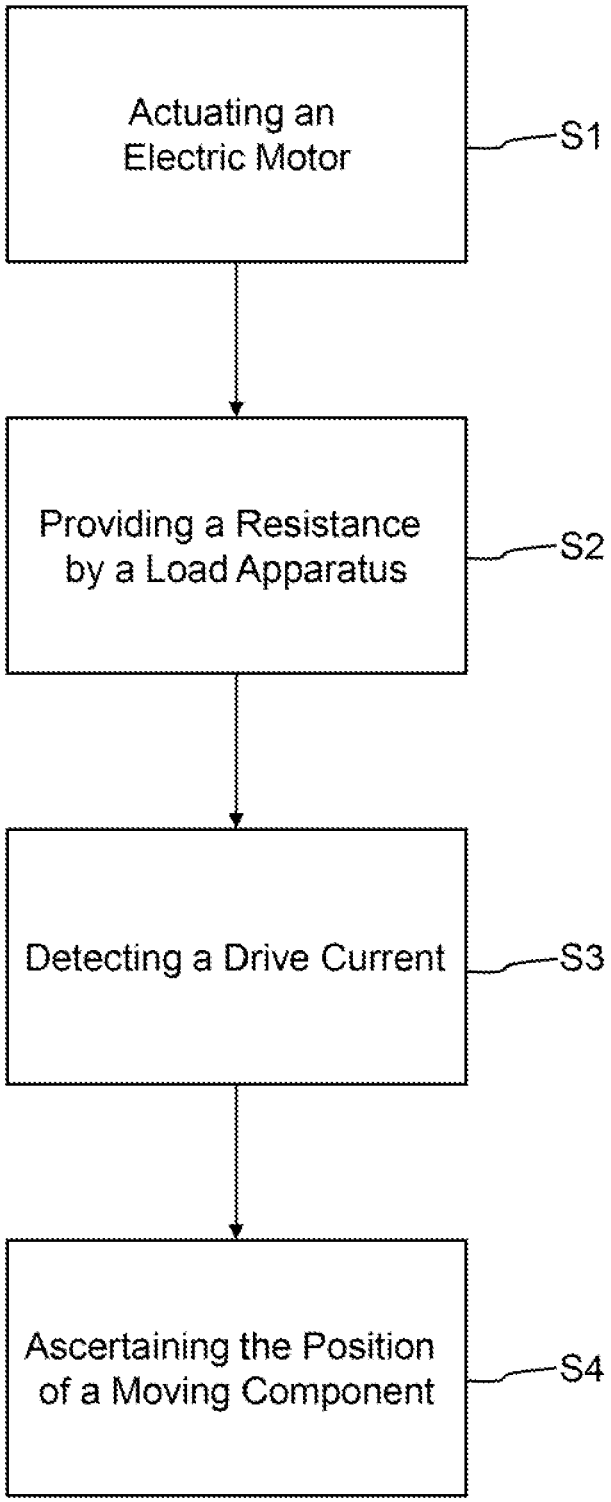
FIG. 5 shows a schematic block diagram of an embodiment of a method for operating a water-conducting household appliance.

FIG. 5 shows a schematic block diagram of an embodiment of a method for operating a water-conducting household appliance 1, for example the household dishwasher in FIG. 1.

In a first method step S1 an electric motor 20 is actuated by a control apparatus 50. This means in particular that the control apparatus 50 supplies the electric motor 20 with a predefined drive voltage and makes available a drive current $I_0$, $I_1$, $I_2$ drawn by the electric motor 20 (see FIGS. 2*a*, 2*b*).

In a second method step S2 a load apparatus 30 (see FIGS. 1, 3*a*-3*c*, 4*a*, 4*b*) provides a resistance, which is a function of a position of a moving component 40 driven by the electric motor 20.

In a third method step S3 the drive current $I_0$, $I_1$, $I_2$ which is drawn by the electric motor 20 and is a function of the resistance provided, is detected. For example the control apparatus 50 has a current measuring device for this purpose. Detection of the drive current $I_0$, $I_1$, $I_2$ can also include storing the detected value.

In a fourth method step S4 the position of the moving component 40 is ascertained as a function of the detected drive current $I_0$, $I_1$, $I_2$. It is ascertained in particular by the control apparatus 50, for example by comparing the detected drive current $I_0$, $I_1$, $I_2$ with values stored in a table.

Although the present invention has been described based on exemplary embodiments, it can be modified in many different ways.

In particular there are many conceivable further variants for the load apparatus. For example, as an alternative to the extensive friction layer illustrated in FIGS. 4*a*, 4*b*, provision can be made for friction points only to be arranged at individual points in order not to increase the basic load. Different materials or coatings can also be provided for the friction layer, having different friction coefficients and therefore bringing about different load states. In addition to the proposed mechanical load apparatuses magnetic ones are also conceivable, influencing a course of movement of the moving component in a predetermined manner as a function of position using appropriately arranged permanent magnets.

The invention claimed is:

1. A water-conducting household appliance, comprising:

a moving component comprising a spray arm of a dishwasher, the spray arm being configured to perform a rotating movement about an axis;

an electric motor for rotatably moving the spray arm;

a load apparatus configured to apply a resistance to counter the rotating movement of the spray arm as a function of a position of the spray arm, the load apparatus being configured to apply the resistance a plurality of times as a function of a degree of rotation of the spray arm over one complete movement amplitude of 360 degrees; and a control apparatus for actuating the electric motor, said control apparatus being configured to detect a drive current which is drawn by the electric motor and is a function of the resistance applied by the load apparatus and to ascertain the position of the spray arm as a function of the detected drive current.

2. The water-conducting household appliance of claim 1, wherein the load apparatus comprises a transmission unit for coupling the electric motor to the moving component.

3. The water-conducting household appliance of claim 2, wherein the transmission unit is configured to reduce a rotation speed of the electric motor by a predefined factor when coupling the electric motor to the moving component.

4. The water-conducting household appliance of claim 1, wherein the load apparatus is configured to apply the resistance according to a predetermined load function as a function of a degree of rotation of the moving component.

5. The water-conducting household appliance of claim 1, wherein the load apparatus is configured to apply the resistance as an increased resistance or as a reduced resistance relative to a basic resistance, which corresponds to a resistance when the moving component moves without activation of the load apparatus.

6. The water-conducting household appliance of claim 1, wherein the control apparatus is configured to actuate the electric motor as a function of the ascertained position of the moving component in such a manner that the moving component is moved into a predetermined position.

7. The water-conducting household appliance of claim 1, wherein the control apparatus actuates the electric motor to perform the one complete movement amplitude to ascertain a current load function of the moving component and detects the drive current that has been drawn by the electric motor.

8. The water-conducting household appliance of claim 1, wherein the control apparatus is configured to identify blocking of the moving component as a function of the drive current drawn by the electric motor.

* * * * *